United States Patent [19]

Bowman

[11] 4,105,354

[45] Aug. 8, 1978

[54] PATTERN FORMING WHEEL FOR UNCURED CONCRETE SURFACES

[76] Inventor: Bradshaw Bowman, P.O. Box 131, Escalante, Utah 84726

[21] Appl. No.: 791,574

[22] Filed: Apr. 27, 1977

[51] Int. Cl.[2] ..... E01C 23/02

[52] U.S. Cl. ..... 404/72; 172/540; 404/124; 404/89

[58] Field of Search ..... 404/124, 122, 89, 128, 404/132, 72, 121, 103, 100, 83; 301/43; 172/540

[56] References Cited

U.S. PATENT DOCUMENTS

| | | | |
|---|---|---|---|
| 324,166 | 8/1885 | Riordan | 404/124 |
| 397,731 | 2/1889 | Laird | 404/124 |
| 519,919 | 5/1894 | Maurer | 404/124 |
| 557,006 | 3/1896 | Miller | 404/124 X |
| 1,099,185 | 6/1914 | Loveland | 404/124 |
| 1,626,879 | 5/1927 | Shidler | 404/124 |
| 2,582,199 | 1/1952 | Gardner | 404/124 |
| 3,192,838 | 7/1965 | Cook | 404/132 |
| 3,832,079 | 8/1974 | Moorhead | 404/124 X |

*Primary Examiner*—Nile C. Byers
*Attorney, Agent, or Firm*—David B. Harrison

[57] ABSTRACT

A worker ballasted, propelled and guided wheel-like tool for imprinting predetermined surface patterns upon a slab of freshly cast, smoothed, yet still plastic concrete is disclosed. The wheel includes a generally cylindrical frame which is large enough to accommodate a worker in a walking position therewithin. The frame supports a plurality of rigid blades carried about the outside thereof, the blades being configured to provide the patterns desired. A walkway is provided on the inside of the frame for the worker and the frame may also be gripped by the worker as a handle, if desired. The weight of the worker is combined with the weight of the wheel to aid in driving the blades into the surface of the slab to a predetermined depth. The walkway enables the worker, by a walking movement in a forward direction, to propel the wheel over a path of the slab directed by the worker thereby forming the predetermined surface pattern therein. A plurality of tools of the same diameter may be peripherally linked together to increase simultaneous pattern imprinting width so that the combination of peripherally linked tools will span the width of larger slabs being poured.

18 Claims, 13 Drawing Figures

FIG. 2
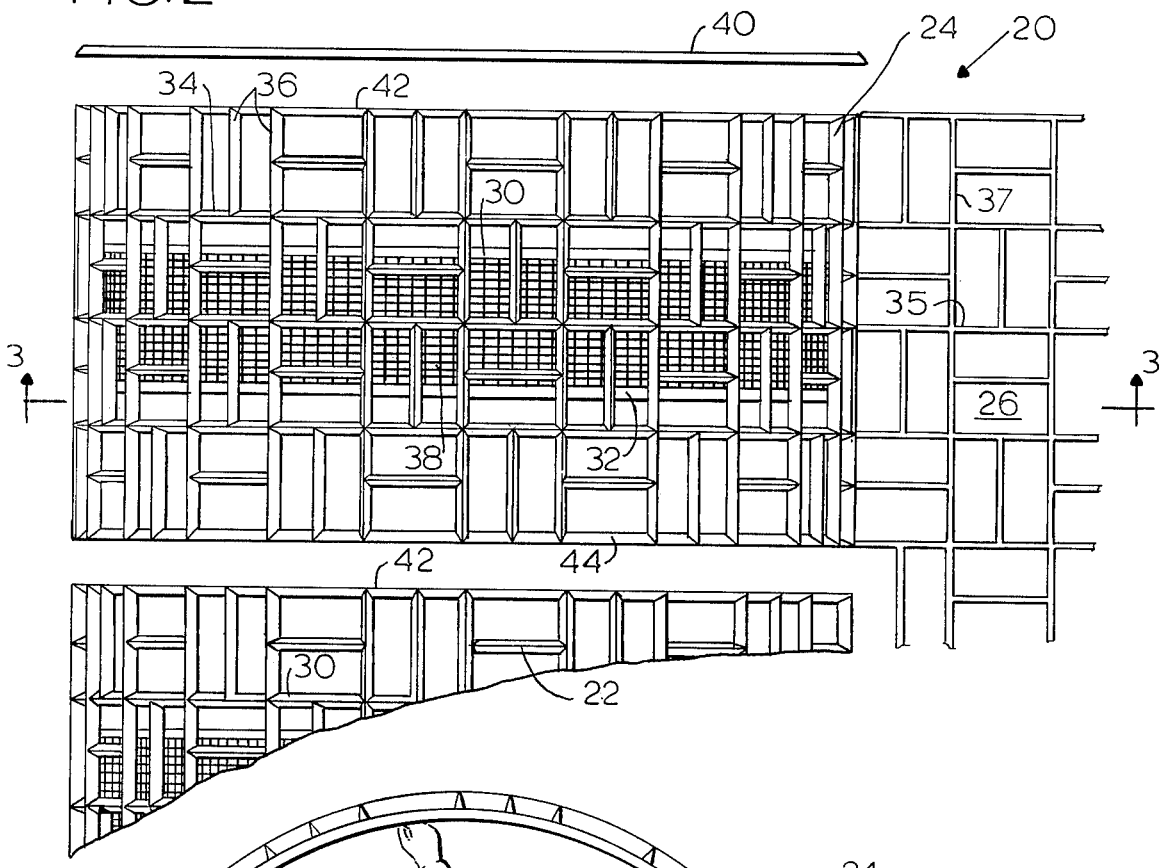
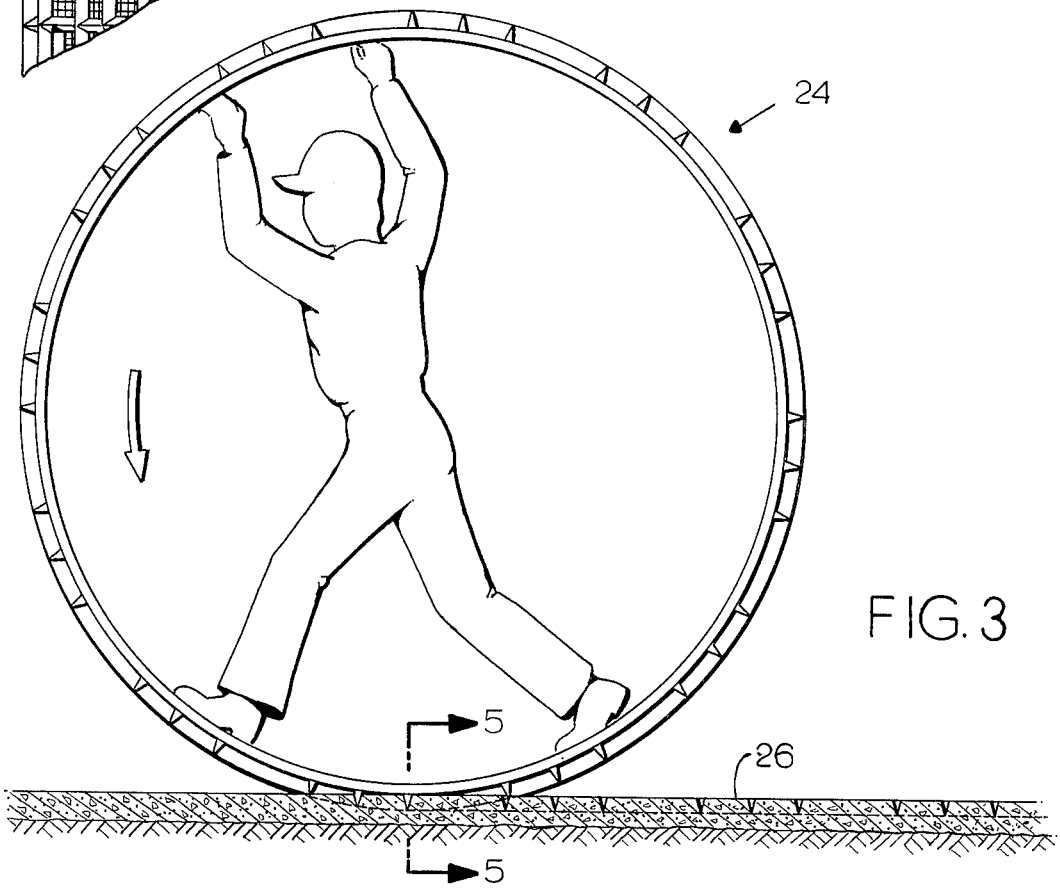
FIG. 3

PATTERN FORMING WHEEL FOR UNCURED CONCRETE SURFACES

BACKGROUND OF THE INVENTION

This invention relates to apparatus for forming surface patterns upon the surface of an uncured concrete slab, and more particularly relates to a wheel-like apparatus having a worker therein to provide some of the downward driving forces, as well as propulsion and directional control, the wheel having pattern forming blades therearound which penetrate the surface of the slab to provide the patterns.

Some years ago I invented a method of manufacturing bricks, tiles, cobblestones and the like by driving forming blades into the plastic surface of a freshly cast slab of concrete to form grooves therein and later filling the grooves with a grout of mortar. That method is described in U.S. Pat. No. 3,406,618 which issued to me on Oct. 22, 1968. While that method has been successfully utilized to form bricks, tiles and cobblestones and the like on floor and walking surfaces, its implementation has had a number of drawbacks.

The tools which formed the patterns in the practice of my invention were flat, snowshoe-like grids which weighed approximately forty pounds apiece. Those grids were provided with handles and striking anvils and had to be manually lifted into place and then driven by blows from a hammer to force the blades on the underside of the grid into the surface of the concrete. The tremendous forces required to sink the grid blades into the concrete surface stemmed directly from the relatively large area of the grid blades in contact with the concrete surface. Also, those tools were heavy to lift and difficult to realign during the pattern making operation. The hammer driven technique of using those grid tools not only was slow and tedious but also resulted in the concrete tending to become set up before the pattern was completed. Consequently, my original techniques invited tool breakage and failures resulting from attempts to complete the pattern after the slab had become set and too hard to work.

Another drawback of my original grid tool was its creation of small ridges of concrete between otherwise linearly aligned grooves which occurred between adjacent patterns formed by the grid tool. As the tools were positioned and driven into the slab, unpatterned concrete surfaces were left where the tools would not or could not touch each other when driven into the surface. Those unwanted ridges resulting from the misalignment of the tools were usually removed after hardening of the slab, e.g., by manually chipping and breaking with a hammer and chisel and then manually collecting chipped fragments. The drawback of the unwanted ridges is overcome by my present invention.

Still another drawback of my grid tools were that they tended to bounce away from each other when driven into the concrete surface. This tendency not only resulted in the undesirable ridges, it also adversely affected alignment of the pattern.

A further drawback was that for large slabs, or example, fifty thousand square feet, the pouring and finishing contractors has to treat the construction as a series of small slabs, for example, fifty separate pours and finishes which made my prior method slow and often prohibitively expensive for those larger slabs.

The imprinting tool I invented for forming nonrepeating stone patterns in fresh concrete (described in U.S. Pat. No. 3,807,888, issued to me on Apr. 30, 1974), had the same drawbacks and limitations as my grid-like tools, particularly for large slabs of thousands of square feet. It was a manual tool that had to be put repeatedly in place and driven into the surface of the slab.

One user of my pattern-forming system, William V. Moorhead, proposed to overcome the above-mentioned drawbacks and limitations of my manually driven pattern forming tools by axle-mounting a pattern roller to a tractor frame and providing a release agent, such as plastic film, between the blades of the roller and the still plastic concrete surface. His apparatus and processes are described in his U.S. Pat. No. 3,832,079, issued Aug. 27, 1974. One inherent drawback of the Moorhead invention was that the cross sectional diameter of the roller was much too small in relation to the depth of penetration required of the pattern-forming blades secured thereto. As the roller traveled across a freshly poured slab, the blades bent, tore, and broke the concrete edges at each penetration. The provision of the conventional release mechanism of the plastic film reduced the tearing and breakage at the edges of the grooves somewhat, but had the undesirable effect of rounding the concrete mass between the grooves which made the finished floor surface difficult, uncomfortable, and perhaps unsafe to walk upon. Moreover, the tractor device disclosed in the Moorhead U.S. Pat. No. 3,832,079 if ever built, would have been unwieldy and very difficult to maneuver into position and to operate, and would have tended to become bogged down in the freshly poured concrete. It would have been a very expensive device to manufacture and maintain, and difficult to operate properly. The Moorhead concept was generally not well accepted in the trade and was limited to usage in conjunction with the plastic release film. It was a fixed-width roller and as such had all of the prior art disadvantages associated with the surface patterning of slabs substantially wider than the roller.

OBJECTS OF THE PRESENT INVENTION

One object of the present invention is to provide a continuously rollable axleless cylindrical pattern forming tool which overcomes the limitations and drawbacks of prior art tools, particularly grid tools and other types of walking tools.

Another object of the present invention is to provide a pattern forming tool which imprints grooves into formable concrete surfaces continuously without constant manual lifting and relocating of the forming tool, and without loss of pattern alignment.

A further object of the present invention is to provide a system of interconnectible pattern forming rolling tools which may be linked together peripherally to enable formation of surface patterns upon very wide slabs of freshly poured concrete.

Yet another object of the present invention is to provide a pattern forming tool which is capable of rapidly and continuously imprinting grooves into the entire surface of a large cast concrete slab before it solidifies to a point of unworkability.

A still further object of the present invention is to provide a generally cylindrical wheel-like pattern forming tool having an open interior space of an inside diameter sized to admit a worker and enable the worker to walk therein.

These and other objects and advantages are accomplished by an improved wheel-like forming tool in accordance with the principles of the present invention will now be described.

SUMMARY OF THE INVENTION

A worker ballasted, propelled and guided wheel-like imprinting device for imprinting predetermined surface patterns into the surface of a freshly poured concrete slab is made of generally cylindrical or polyhedronal frame of open construction. The frame has an inside diameter sufficient to admit and enable a worker to walk therein and must be of this diameter so that the imprinting blades will imprint to a desired depth, typically five eighths to three fourths of an inch. The frame carries and secures an array of pattern forming rigid blades about the outside thereof. The blades are configured to provide the imprinting patterns desired and may be formed of metal, plastic or hard rubber segments which are detachable, rearrangeable, and interchangeable relative to the frame, so that a wide variety of differing patterns may be imprinted with a single wheel. A walkway is provided by the inside of the frame to support the worker and to transfer his weight through the frame to the blades below the worker which come into contact with and penetrate the concrete surface as the wheel is rolled along. The worker directs the wheel as he propels it in a forward rolling motion over the slab by a walking movement in a forward direction. The wheel is thus propelled over a path of the slab which is as wide as the wheel and of a length fixed by the distance of travel of the wheel rolling over the slab.

The invention also includes an extended width pattern forming tool and a locking system for locking a plurality of pattern forming wheels at their peripheries into an axial alignment to provide the extended width pattern forming tool for imprinting patterns upon wide slabs. Typically the wheels would be available in a number of varying widths, such as one, two, three and four feet wide, so that they may be selectively locked together to match the width of the slab being patterned.

The wheel may be collapsible into half sections and smaller segments and components so as to facilitate transportation to and from job sites and to promote ease in manufacture, assembly, usage and repair. The wheel frame may be of a series of pivotally interconnected beams which provide the requisite strength and cylindrical shape when assembled and which may be collapsed into a small space for ease of handling.

Other objects, advantages and features of the present invention will become apparent upon consideration of the following preferred embodiments presented together with the accompanying drawings.

BRIEF DESCRIPTION OF THE DRAWINGS

FIG. 2 is a diagrammatic top plan view of the tools shown in FIG. 1 with the tools shown separated and with one of the tools and the concrete slab broken away to save drawing room.

FIG. 3 is a somewhat diagrammatic view in side elevation and section of one of the tools shown in FIG. 2, taken along the line 3—3 in FIG. 2.

DETAILED DESCRIPTION OF PREFERRED EMBODIMENTS

Figure 1:
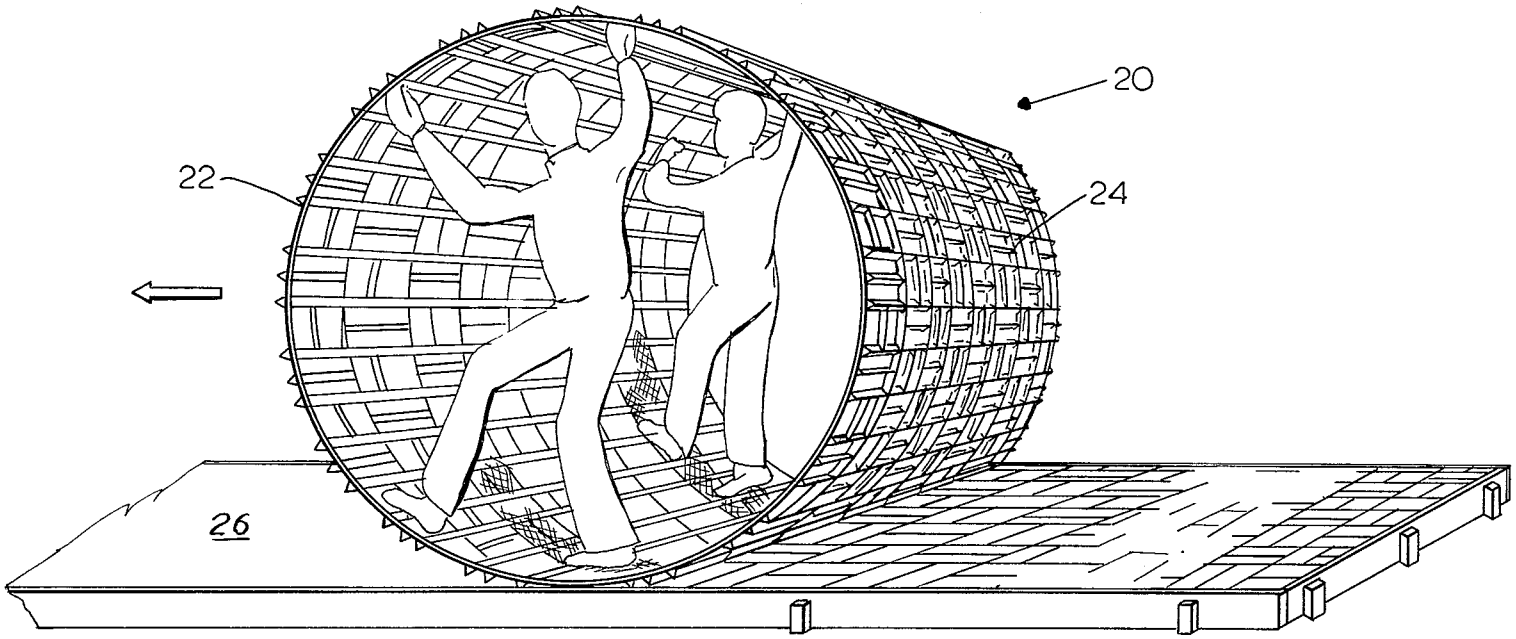
FIG. 1 is a perspective view of a preferred embodiment of two peripherally linked tools in accordance with the present invention which are being operated by two workmen for imprinting surface patterns upon a slab of freshly cast concrete.

Referring to FIG. 1, a worker ballasted, propelled and guided wheel-like tool 20 which embodies the principles of the present invention is shown performing its intended operation of imprinting upon a fresh slab of concrete a predetermined matrix of surface patterns which will be finished by placement of grout therein to create the appearance of laid brickwork, tiles, cobblestones, etc. The tool 20 shown in FIG. 1 includes two separate wheels 22 and 24 which are joined together along the common periphery to form the tool 20. It could be as large as five or six separate wheels or more, in accordance with the width of the slab being poured. Each pattern forming tool 22, 24 is typically twenty four to forty eight inches wide and about six feet in outside diameter, and the width of the tools as well as the width of the slab being patterned will be taken into account to determine the number of tools to be linked together peripherally. Some tools may be, e.g., only twelve inches wide, so that when linked into oth eer tools, a wide range of slab widths may be accommodated.

As shown in FIG. 1, the tool 20 is being rolled along the slab 26 of freshly poured and still plastic concrete in the direction of the pour (which is shown by the arrow on the unpatterned surface of the slab 26). The pour is contained by the usual forms 28 in place on the ground which enclose and define the periphery of the slab. Two workers are shown inside the composite tool 20 and are propelling it along in the direction of pour by walking in a forward direction to achieve a squirrel-cage like propulsion, albeit at a very slow velocity in the forward direction.

Cylinder tools 22 and 24 are shown in greater detail in the diagrammatic plan view of FIG. 2. Therein, each wheel 22, 24 is seen to include a frame which may be conveniently made of annular members 30 and 32 lying in parallel planes. To the frame of members 30 and 32 are secured a gridwork of blades, there being longitudinal blades 34 and transverse blades 36 which are mounted at right angles to the longitudinal blades 34. Each blade 34, 36 preferably defines an acutely angled, inverted V-shape in cross section and functions to penetrate the concrete slab 26 to form grooves therein which are typically about five eighths to three quarters of an inch in depth, a depth found in practice to be sufficient to retain mortar which is placed in the grooves after the slab 26 has set.

The blades 34, 36 shown in FIGS. 2, 3, 4 and 5 are constructed of thin wall V-shaped steel channels which are end-welded together at intersections. Alternatively, the blades 34, 36 may be castings of very hard rubber. Preferably, the castings would be in detachable section which would lock together and clip to the frame of the tool 22, 24 as discussed in connection with FIGS. 7 through 11 hereinafter. Ideally, each detachable section is realignable to form a pattern rotated by ninety degrees so that a pattern to be made will be unaffected by the direction of travel of the tool 22, 24. That is to say, to change wheel direction by a right turn, without changing the pattern, the blade segments would be detached, rotated ninety degrees, and then reattached to the frame of the tool 22, 24. Preferably, each blade segment would be of a standard geometry such as a square.

A continuous cylindrical walkway 38 of open mesh wire grid work is secured in the central portion of each wheel 22, 24 and provides a positive tread surface upon which a worker walks to propel the wheel 22, 24 along the slab 26. To facilitate inspection of the surface of the slab 26 during the patterning operation, it is preferable that the tool 22, 24 be of open construction, including the walkway 38. With an open construction, the worker can reach through openings to trowel the just patterned surface to remove defects in the pattern caused, e.g., by aggregates in the concrete.

Figure 5:
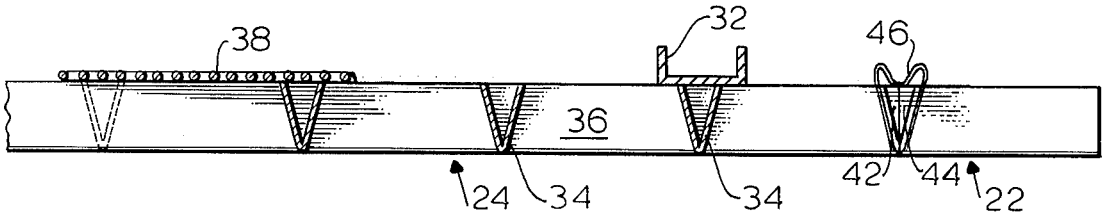
FIG. 5 is an enlarged view in front elevation and section of the tool shown in FIGS. 2 and 3, along the line 5—5 in FIG. 3.

As shown in FIG. 1, the wheels 22 and 24 are joined together at adjacent peripheral edges to form one tool 20. It is intended that each wheel 22, 24 be capable of joining with other similarly sized wheels to form a tool which may include, e.g., up to five or six separate wheels or more if needed. Consequently, an outside half blade 40 in the form of an attachable annular ring is provided for attachment to a complementary half blade 42, 44 formed at the edge of each wheel 22, 24. This half blade 40 is clipped onto its mating half blade 42 or 44 by a series of suitable clips 46 of spring steel, one of which is shown in FIG. 5. Each clip 46 is preferably configured so that it holds the mating half blades together without noticeably disfiguring the pattern of the blades at the clip location. Clips 46 would also be used to secure the cast rubber blade sections to the frame of the tool 22, 24.

Each cylinder 22, 24 joins at its outer periphery 42 or 44 with the adjacent peripheral half blade edge 44 or 42 of the adjacent wheel. The half blades 42 and 44 of adjacent wheels 22 and 24 are held together by a suitable mechanism such as a series of clips 46. The clips 46 enable the cylinders 22 and 24 to move slightly, relative to one another, about the common axis, so that each cylindrical tool 22, 24 is capable of printing its intended patterns, even on slightly curved surfaces, often encountered on large slabs contoured to provide surface drainage.

Figure 6:
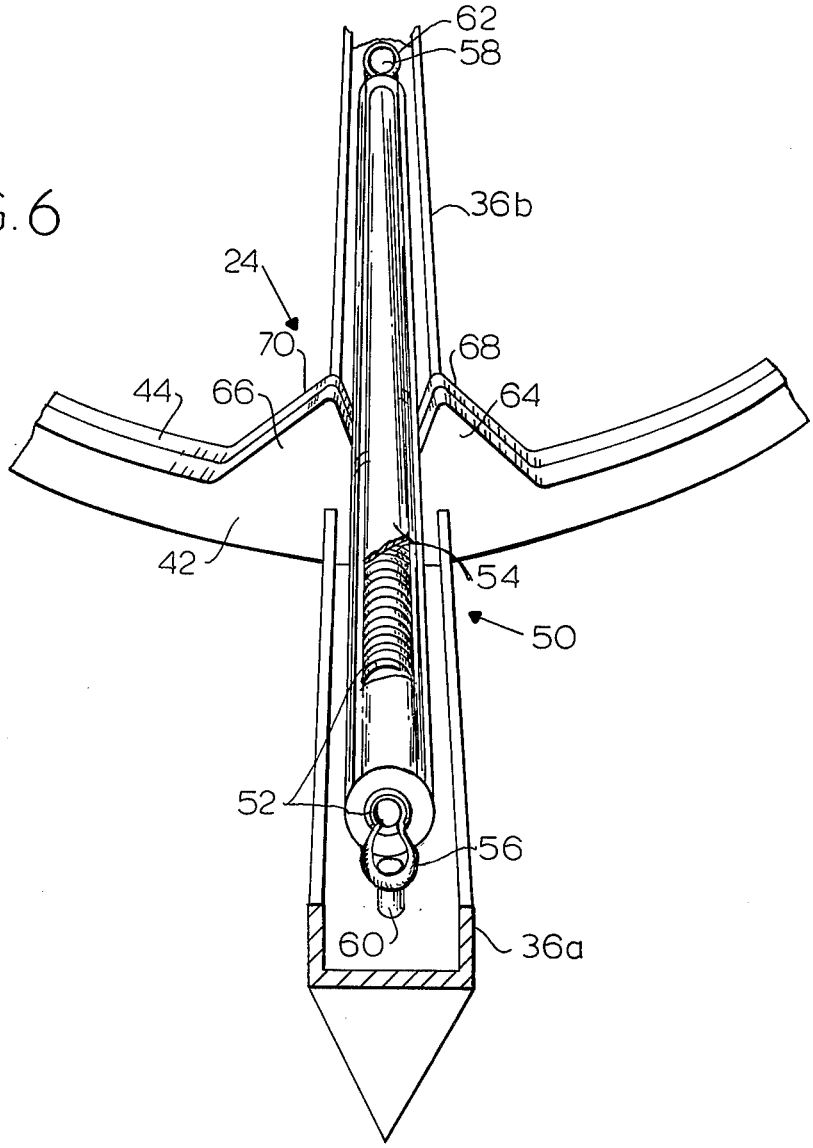
FIG. 6 is an enlarged fragmentary view in perspective of an alternative form of mechanism for interlocking the tools shown in FIG. 1 together along the common periphery thereof.

An alternate locking mechanism 50 shown in FIG. 6 not only locks the adjacent wheels 22 and 24 together, it maintains the correct alignment of the pattern between the wheels 22 and 24. Each mechanism 50 includes a coiled spring 52 placed inside of a cylindrical tube 54. Fastening loops 56 and 58 are provided at each end of the spring 52 and are snapped over locking posts 60 and 62 displaced along one axially aligned transverse blade structure 36, the blade **36*a* being part of the wheel 22 and the aligned blade 36*b* being part of the wheel 24**.

The half blade outer edges 42 and 44 of the wheels 22 and 24 are provided with symmetrical shoulder projections, there being two oppositely facing projections 64 and 66 on the outer edge 42 and there being two identically sized and spaced, oppositely facing projections 68 and 70 on the outer edge 44. The cylindrical tube 54 fits closely within a space defined by and between the shoulders 64, 66, 68 and 70 and thereby locks the wheels 22 and 24 into correct radial pattern alignment. The spring 52 is stretched and locked over the posts 60 and 62 and thereby pulls the wheels together. The tube 54 lies flat against the tranverse blade structure 36 to hold the wheels 22 and 24 in axial alignment.

In order to lock two tools 22, 24 together, it is to be understood that there is a series of locks 50 spaced about the common periphery thereof. The mechanism 50 holds the tools 22, 24 tightly together for flat surface contours yet yields so that slight slopes may be accommodated.

Figure 4:
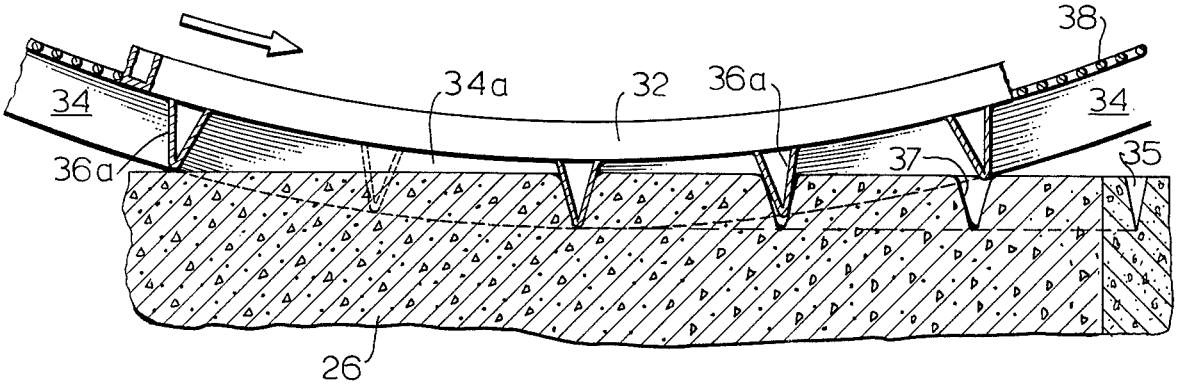
FIG. 4 is an enlarged view in side elevation of that part of the tool shown in FIG. 3 which is in contact with the concrete slab.

The operation of the tool 20 and each wheel 22, 24 is perhaps best explained in connection with FIGS. 3 and 4. A worker inside the wheel 24 slowly treads along the walkway 38 thereof and thereby propels the wheel 22 or 24 in a forward direction across the slab 26. The worker may grasp the open grid work formed by the blades 34 and 36, as suggested by FIG. 3, or inside rails at the edges of the walkway 38 may be provided as hand grasps. The weight of the worker is combined with the weight of the wheel 24 into a downward force which is concentrated in those segments **34*a* and 36*a* of the blades 34 and 36 which are actually in contact with the surface of the slab 26 and make longitudinal depressions 35 and transverse depressions 37 therein as the wheel rolls along in a circular direction shown by the arrows in FIGS. 3 and 4. If the weight of the worker combined with the weight of the wheel 24 provides insufficient driving force, on account of the lack of plasticity of the concrete surface, the worker may jump up and down or otherwise provide additional driving forces to the wheel 24** to imprint the pattern.

Figure 7:
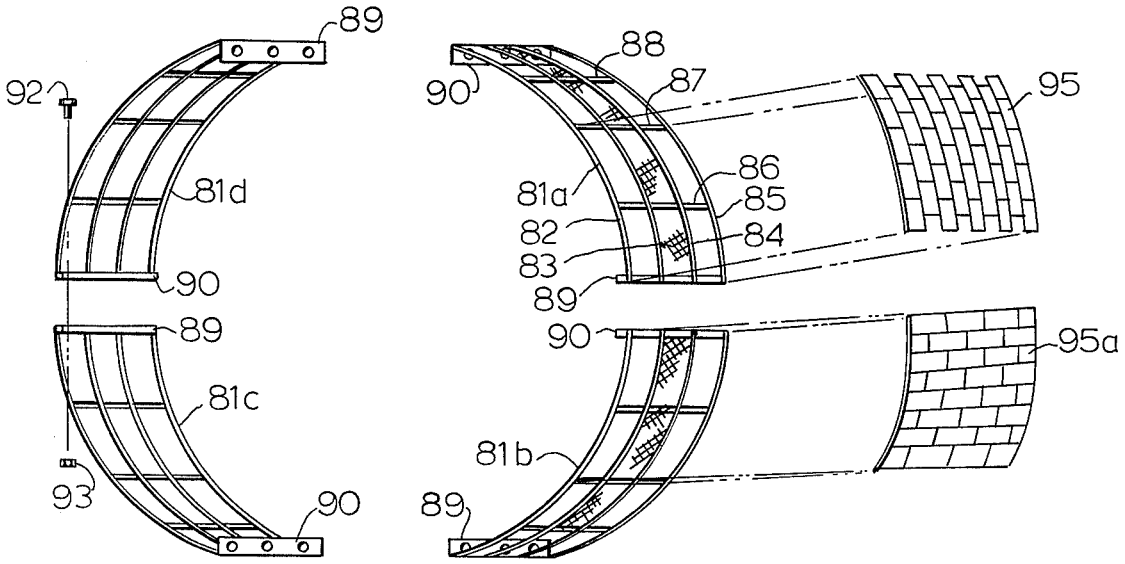
FIG. 7 is a somewhat diagrammatic exploded view in perspective of a tool made in accordance with the present invention with all but one section of a blade array omitted.

A wheel-like pattern forming tool 80, also in accordance with the present invention, is shown in FIGS. 6 and 7. The tool 80 includes a frame 81 which is separable into four quarter sections **81*a*, 81*b*, 81*c* and 81*d* for ease of transportation and handling. Each section includes four quarter round longitudinal members 82, 83, 84 and 85 which are joined together by three straight transverse brace members 86, 87 and 88 and by end flanges 89 and 90. The flanges 89 and 90 are complementary in the sense that a flange 89 of one section abuts against a flange 90 of an adjacent section. Holes 91 in the flanges 89, 90 enable bolts 92 to be passed through and secured by nuts 93 so that the sections 81*a*, 81*b*, 81*c* and 81*d* may be rigidly joined together at the job site to provide the continuous cylindrical frame 81. An open mesh grid work 94 is welded between the two inner longitudinal members 83 and 84 of each section of the frame to provide a walking surface for a worker who will be operating the tool 80**.

A series of generally square pattern forming blade grids 95 is secured about the periphery of the outer area of the frame 81. A blade grid 95, shown in FIGS. 7 and 8, defines the pattern for conventional laid brickwork, with the grid 95 shown aligned so that its pattern runs in the same direction as the travel of the tool 80. Another blade grid 95*a* defines the same pattern as the grid 95; however, the grid 95*a* is aligned so that its pattern is normal to the pattern of the grid 95. It is to be understood that the patterning grids 95, 95*a*, etc. may be rotated by the workers at the job site by ninety degrees so that the pattern runs with, normal to, or alternating with respect to the direction of travel of the tool 80.

In order for the grid 95 to adapt in two different pattern directions to the curve of the frame 81, the grid 95 is preferably cast or otherwise formed of a very hard elastomeric material, such as hard rubber, having a durometer hardness of, e.g., 100. The generally square geometry of the grid 95 further enables it to be positioned in two pattern directions. If the pattern for the grid 95 is to be printed in one alignment only, then the grid 95 is of rigid metallic or hard plastic material.

Figure 8:
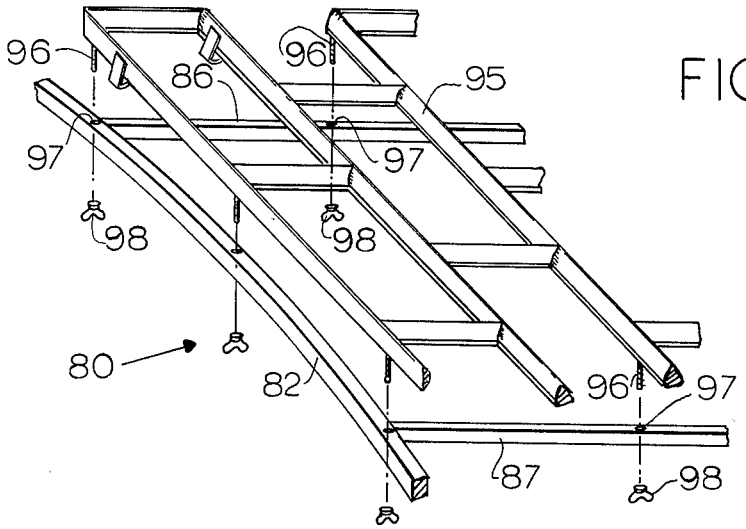
FIG. 8 is an enlarged fragmentary view in perspective of a portion of the frame and removable blade of the tool shown in FIG. 6.

One technique for securing the cast rubber grid 95 to the frame 81 is illustrated in FIG. 8. As seen in FIG. 8, the grid 95 is cast with a series of downwardly projecting threaded studs 96 which align with holes 97 in the longitudinal and transverse members of the frame. Wing nuts 98 engage the threaded studs and securely fasten the grid 95 to the frame 81, thereby holding it in a slightly curved configuration. The layout of the studs 96 and holes 97 is made carefully so that the studs 96 will align with the holes 97 in the two different pattern alignments of the grid 95.

Many other fastening techniques are equally well suited to the task of securing the grid to the frame, and the technique shown in FIG. 8 is one example. Two other examples of fasteners are found in FIGS. 9, 10 and 11.

Figure 9:
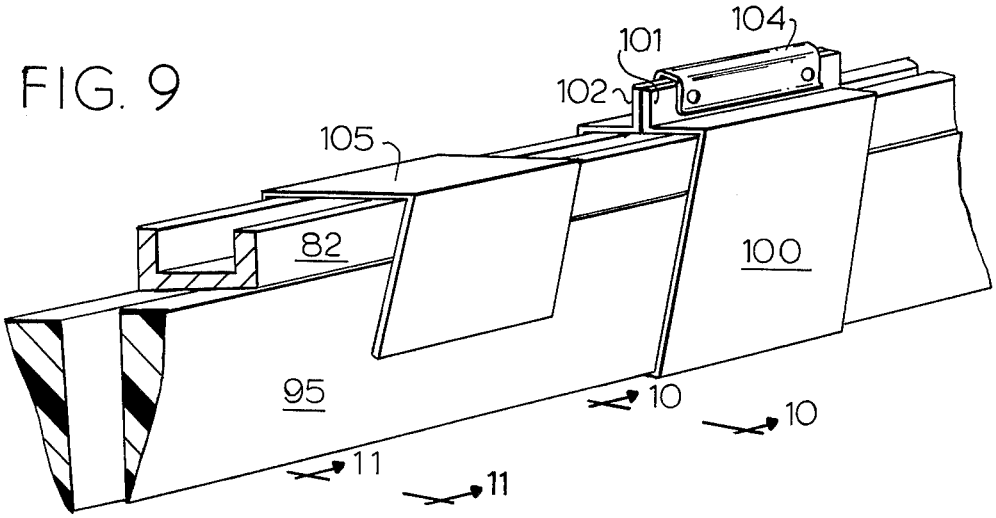
FIG. 9 is an enlarged fragmentary view in perspective of a portion of the frame and removable blade of the tool shown in FIG. 6, illustrative of alternative forms of blade securing clamps.
Figure 10:
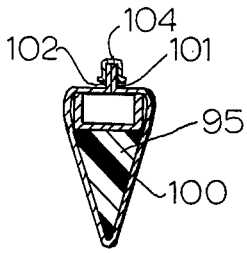
FIG. 10 is a view in elevation and section along the line 10—10 in FIG. 9.

In FIGS. 9 and 10, an imprinting blade 95 is held securely in place against a V-shaped channel iron frame section 82 by a full length clip 100 of thin spring steel. The clip 100 is applied by sliding over first the blade 95, then the frame section 82, and finally to snap into place closely thereover. Oppositely abutting flanges 101 and 102 at the open end of the clip 100 are spread during application and approach each other closely once the clip is seated in place. A locking clip 104 may be snapped over the flanges 101 and 102 to push them together to lock the clip 100 in place.

Figure 11:
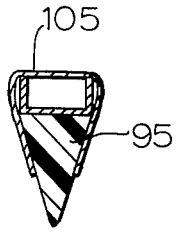
FIG. 11 is a view in elevation and section along the line 11—11 in FIG. 9.

A half length blade clip 105 of thin spring steel is shown in FIGS. 9 and 11. The half clip 105 is emplaced by sliding over the frame section 82 first and then over the upper position of the blade 95. The thinness of the clips 100 and 105 enables them to be used effectively for securing the blade 95 to the frame 82 without impairing the quality of the imprint made upon the plastic concrete surface by the tool 80.

The tool 80 may be peripherally linked to other wheels in the manner previously described in connection with the wheel 20 to form a wide patterning instrument.

Figure 12:
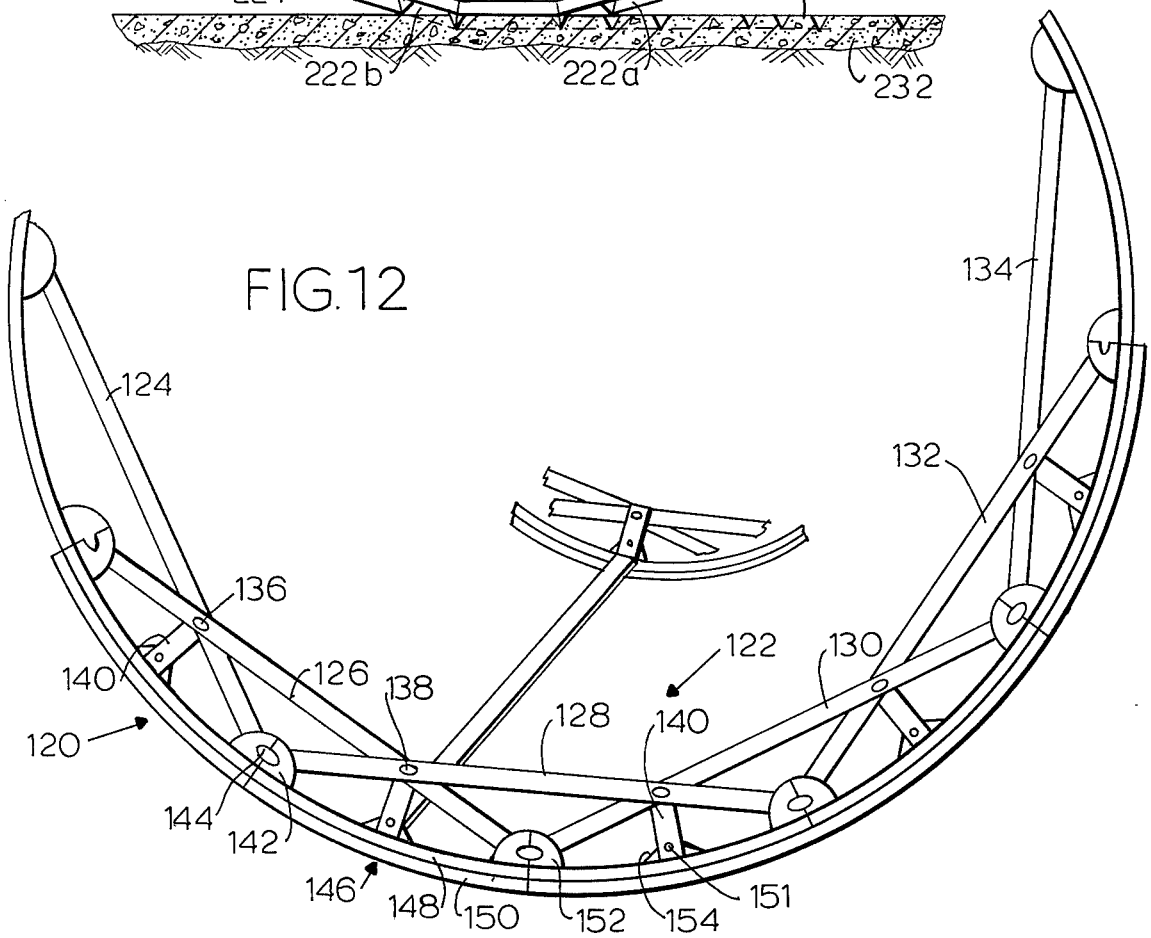
FIG. 12 is a diagrammatic view in side elevation of a portion of another preferred embodiment of a pattern making tool in accordance with the present invention.

Another alternate preferred embodiment of a collapsible frame and blades of a wheel-like pattern forming tool 120 is shown in FIG. 12. The tool 120 includes a frame 122 made up of a series of interlinked straight braces 124, 126, 128, 130, 132, 134, etc. Each brace 124 through 134 is substantially identical and is joined to two other braces at pivotal fastening locations spaced apart along each brace. For example, the brace 126 is joined to the brace 124 at a fastening location 136 and to the brace 128 at the fastening location 138. Each fastening location may include a dowel or other suitable locking pin at a transverse brace 140. Each brace is joined at its end to another brace at a further joint, for example, the brace 124 is joined to the brace 128 at a joint 142 by a pin 144; and so forth, until all of the braces interlock to form the rigid cylindrical frame 122 for the wheel 120. The pins, e.g., 136, 138, 144 are removable and thus enable the frame 122 to be collapsed for ease in transportation of the wheel 120.

Secured to the outside of the frame 122 are a plurality of dies 146 which include a base portion 148 and a blade portion 150 which extends outwardly from the base portion 148. The dies may be of metal or hard cast rubber or other suitable material. The base portion 148 of each die 146 is an open grid work from which the blade portions 150 extend to define the patterns that will be cut into the surface of the concrete. Integrally formed with the base 148 are locking sections 152 and 154 which engage the locking pins 144 at the joints 142 and engage pins 156 which pass through the transverse braces 140 and through the projections 154, so that each die 146 is secured to the frame 122. Each die 146 is sufficiently hard so that the die is not deformed from its intended shape during utilization of the wheel 120, yet sufficiently resilient so that each die 146 may be rotated by ninety degrees to change the direction of the pattern of the blade portions 150 thereof. Suitable projections 152 and 154 would be provided to lock the die 146 in either position. Thus, the dies 146 may be arranged to provide a plurality of different patterns. Typically each die 146 is about three feet square, there being six such dies per wheel 120.

As with the first preferred embodiment of tool 20, shown in FIGS. 1 through 6, the tool 120 may be arranged as a plurality of peripherally linked wheels so that a wide slab of freshly poured concrete may be patterned by one rolling operation of the combined assemblage of wheels 120.

Figure 13:
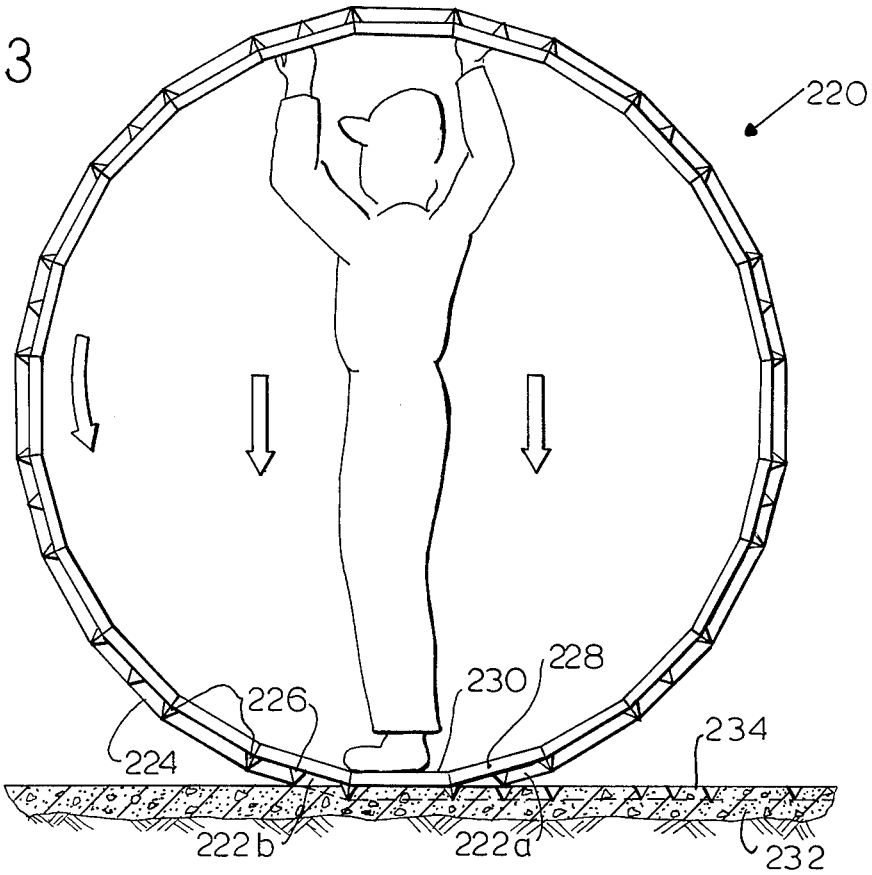
FIG. 13 is a somewhat diagrammatic view in side elevation and section of another preferred embodiment of a pattern making tool in accordance with the present invention.

A further alternative embodiment of the present invention, shown in FIG. 13, includes a pattern forming wheel 220 in the form of a multi-faceted polyhedron wherein each facet 222 may be a separate, substantially planar pattern forming grid. Each grid 222 includes longitudinal blades 224 intersecting transverse blades 226 to define, e.g., a brick pattern. Other arrangements of the blades 224, 226 would provide patterns for tiles, cobblestones, etc. Each grid 222 is secured to a common polyhedron frame 228 either rigidly or detachably, for ease of interchangeability of patterns.

The wheel 220 works especially well for pours of drier, less plastic concrete slurries, and it enables the worker to jump up and down on a walkway 230 (attached on the inside of the frame 228) as each facet 222 comes into planar alignment with the surface of a slab 232 being poured and then patterned with the tool 220. If additional force is needed to drive the facet 222 into the surface of the slab 232, a tamping device such as a mallet, sledge hammer or other like tool may be used against the facet 222 being driven in. In FIG. 13, the facet 222*a* is shown being driven downward, into the surface 234 by an upward and downward stepping or jumping force provided by the worker inside the tool 220. Once the blades 224 and 226 of the grid 222*a* are driven into the surface 234 to their intended depth, the wheel 220 is rotated forwardly by a controlled forward stepping motion of the worker until the next adjacent facet **222*b* comes into planar alignment with the surface. Then the worker drives the grid 222*b* to the appropriate depth, and so forth until the slab 232** is completely patterned.

To those skilled in the art to which this invention relates, many changes in construction and widely differing embodiments and applications of the invention will suggest themselves without departing from the spirit and scope of the invention. The disclosures and the description herein are purely illustrative and are not intended to be in any sense limiting.

I claim:

1. A worker driven, axleless imprinting tool for imprinting predetermined surface patterns upon a slab of freshly cast, surface smoothed and floated, yet still plastic concrete, comprising:

frame means of generally cylindrical geometry having an inside diameter sufficiently large to accommodate a worker in a walking position in a circumferential direction therewithin, said frame means for supporting said worker;

blade means positioned continuously about the outside area of said frame means, said blade means for penetrating into and withdrawing from the surface of said still plastic concrete to form said surface patterns therein as said tool is rolled over the surface of said slab;

whereby the weight of said worker is combined with the weight of said tool to aid in driving said blade means into the surface of said slab, and said worker within said frame means by walking motion in a circumferential direction propels said tool in a rolling motion over said surface to provide said predetermined pattern therein.

2. The tool set forth in claim 1 wherein said frame means includes worker walkway means radially extending around the inside thereof for providing a foot path for said worker thereby aiding said walking motion in said radial direction.

3. The tool set forth in claim 1 including handle means secured to said frame means for providing hand grasps enabling said worker to balance himself and to control the direction of said wheel.

4. The tool set forth in claim 1 wherein said blade means comprises a continuous array of interconnected blades to provide said surface patterns.

5. The tool set forth in claim 1 wherein said blade means comprises a series of formed grids detachably mounted about the outside of said frame means and further comprising mounting means for mounting said series about the outer area of said frame means.

6. The tool set forth in claim 5 wherein each said grid is formed of a slightly resilient, hard elastomer, capable of being mounted to said frame means in two relative pattern alignments, with one alignment being substantially normal relative to the other alignment, and wherein said mounting means is adapted to mount each said grid in each of said alignments.

7. The tool set forth in claim 1 wherein said frame means comprises a series of assembled interlocking spars and cross members which may be disassembled for convenience in transportation, handling and storage.

8. An axleless imprinting wheel for imprinting predetermined patterns into the surface of a slab of freshly cast, surface smoothed, yet still plastic concrete, comprising:

frame means of generally cylindrical geometry of an inside diametral dimension enabling a person to be within said frame means in a walking position in a circumferential direction, said frame means including support means for supporting said person about an interior circumference therein;

blade means secured on the outside of said frame means and extending over the area thereof, said blade means for penetrating into said surface as said wheel is rolled upon said slab;

blade securing means for securing said blade means to said frame means;

whereby the weight and motion of the person within said wheel is added as a driving force to the weight of said wheel in aid of driving said blade means into said surface to a desired depth, and said person propels said wheel in a path over said slab by walking in a circumferential direction upon said frame means.

9. The wheel as claimed in claim 8 wherein said blade means comprises a series of formed grids detachably secured to said frame means.

10. The wheel as claimd in claim 9 wherein each of said series of formed gride comprises a grid section formed of slightly circumferentially flexible yet hard material, said grid section adapted to be mounted in at least two different pattern alignments relative to said frame means, and wherein said blade securing means is adapted to mount said grid section to said frame means in each of said alignments.

11. A combination of a plurality of worker driven, axleless imprinting tools joined together for simultaneously imprinting predetermined surface patterns upon a slab of freshly cast, surface smoothed and floated, yet still plastic concrete, each tool comprising frame means of generally cylindrical and uniformly sized geometry having an inside diameter sufficiently large to accommodate a worker in a walking position in a circumferential direction therewithin, said frame means for supporting said worker; blade means arranged in said predetermined surface patterns being positioned continuously about the outside area of said frame means, said blade means for penetrating into and withdrawing from the surface of said still plastic concrete to form said surface patterns therein as said tool is rolled over the surface of said slab, said combination further comprising adjacent tool joining means for joining together adjacent peripheral edges of adjacent ones of said plurality of imprinting tools.

12. The combination set forth in claim 11 wherein said joining means includes locking means for locking adjacent ones of said joined imprinting tools into fixed radial alignment whereby alignment of said surface patterns may be maintained between adjacent tools.

13. The combination set forth in claim 11 wherein said joining means includes spring means for enabling adjacent ones of said joined imprinting tools to move slightly out of axial alignment to accommodate contouring of the surface of said slab.

14. The combination set forth in claim 11 wherein said adjacent tool joining means includes a series of springs tension mounted between frame means of adjacent ones of said joined imprinting tools and wherein adjacent peripheral edges of said adjacent ones of said tools include radial keying means at the location of each of said springs, and wherein said springs include key means for engaging said keying means whereby to lock said adjacent ones of said imprinting tools into fixed radial alignment.

15. A worker driven, axleless imprinting tool for imprinting predetermined surface patterns upon a slab of freshly cast, surface smoothed and floated, yet still plastic concrete, comprising:

frame means of generally cylindrical, yet polyhedronal geometry having a series of contiguous planar facets and having an inside diameter sufficiently large to accommodate a worker in a walking position in a generally circumferential directin therewithin, said frame means for supporting said worker;

planar blade means mounted to each said facet of said series, said planar blade means for penetrating down into the surface of said still plastic concrete to form said surface patterns therein as a said facet comes into contact with the surface of said slab, as said tool is rotated from facet to facet over the surface of said slab, whereby the weight of said worker is combined with the weight of said tool to aid in driving each said planar blade means into the surface of said slab as its facet aligns against said surface, and said worker by walking motion propels said wheel in a stepping motion from facet to facet over said surface to provide said predetermined pattern therein.

16. The tool set forth in claim 15 wherein each said planar blade means comprises a formed grid detachably mounted to a said facet and further comprising mounting means for mounting said grid to a said facet.

17. The tool set forth in claim 16 wherein each said grid is of a geometry enabling it to be mounted to a said facet in two relative pattern alignments with one alignment being substantially normal relative to the other alignment, and wherein said mounting means is adapted to mount each said grid in each of said alignments.

18. In a method of patterning the exposed surface of an uncured concrete slab to the appearance of laid bricks, tiles, cobblestones and the like, including the steps of forming the concrete slab on the ground, floating the exposed surface of said slab to bring up the finest particles of the concrete material, and driving forming blades in a predetermined pattern conforming to the shapes of said bricks, tiles, cobblestones and the like into said exposed surface to a predetermined effective depth, the improvement comprising the steps of:

(a) providing said blades continuously along the outer area of a large, axleless generally cylindrical wheel having an inside diameter sufficient to accommodate a worker in a walking position therewithin;

(b) driving said blades into said surface to a desired depth by rotating said cylindrical wheel along a path on said surface to be patterned, said rotation of said wheel resulting from walking movements of said worker within said wheel, said blades being arcuately driven into said surface at the location of tangency of said wheel with said slab, and automatically being withdrawn from said slab after penetration by continued rotation of said wheel.

* * * * *